US006435813B1

(12) United States Patent
Rieck, Jr. et al.

(10) Patent No.: US 6,435,813 B1
(45) Date of Patent: Aug. 20, 2002

(54) IMPIGEMENT COOLED AIRFOIL

(75) Inventors: Harold Paul Rieck, Jr., Middletown; Omer Duane Erdmann, Maineville, both of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/568,441

(22) Filed: May 10, 2000

(51) Int. Cl.[7] ..... F01D 9/06

(52) U.S. Cl. ..... 415/115; 415/209.2; 416/96 A; 416/97 R

(58) Field of Search ..... 415/115, 116, 415/189, 190, 209.2, 209.3, 209.4; 416/96 R, 96 A, 97 R, 92

(56) References Cited

U.S. PATENT DOCUMENTS

| | | | | |
|---|---|---|---|---|
| 4,177,004 A | * | 12/1979 | Riedmiller et al. | 415/116 |
| 4,501,053 A | | 2/1985 | Craig et al. | |
| 5,127,793 A | * | 7/1992 | Walker et al. | 415/115 |
| 5,127,795 A | * | 7/1992 | Plemmons et al. | 415/115 |
| 5,328,331 A | | 7/1994 | Bunker et al. | |
| 5,464,322 A | | 11/1995 | Cunha et al. | |
| 5,603,606 A | * | 2/1997 | Glezer et al. | 415/115 |
| 5,655,876 A | * | 8/1997 | Rock et al. | 415/139 |
| 5,873,695 A | | 2/1999 | Takeishi et al. | |
| 6,062,813 A | * | 5/2000 | Halliwell et al. | 415/189 |
| 6,217,282 B1 | * | 4/2001 | Stanka | 415/209.2 |

FOREIGN PATENT DOCUMENTS

| | | | | |
|---|---|---|---|---|
| EP | 892151 A1 | | 1/1999 | |
| SU | 364747 A | * | 3/1973 | 416/97 R |

* cited by examiner

*Primary Examiner*—Christopher Verdier
(74) *Attorney, Agent, or Firm*—William Scott Andes; Sonnenschein, Nath & Rosenthal

(57) ABSTRACT

An airfoil for use in a gas turbine engine. The airfoil includes a body having an interior surface defining a hollow cavity in the airfoil having an inlet and an outlet. The airfoil also includes a partition within the cavity dividing the cavity into a first cooling passage and a second cooling passage. The first cooling passage communicates with the inlet for delivering cooling air to the first passage and the second cooling passage communicates with the outlet for exhausting cooling air from the second passage. The partition has a cooling hole therein extending between the first passage and the second passage permitting cooling air to pass from the first passage to the second passage. The cooling hole is sized and positioned with respect to the interior surface of the airfoil for directing cooling air toward a portion of the interior surface of the airfoil so the cooling air impinges upon the portion. Thus, cooling air entering the inlet of the cavity travels through the first passage for cooling the body by convective heat transfer, through the cooling hole for impinging upon the portion of the interior surface of the body, through the second passage to cool the body by convective heat transfer, and out the outlet of the cavity.

19 Claims, 4 Drawing Sheets

IMPIGEMENT COOLED AIRFOIL

BACKGROUND OF THE INVENTION

The present invention relates generally to gas turbine engine airfoils and more particularly to airfoils having impingement cooling.

Many conventional gas turbine engine vanes and blades have interior passages for transporting cooling air to remove heat. For instance, some conventional turbine blades have a labyrinth of interior passages through which cooling air is transported to cool the blades by convective heat transfer. Cooling holes in the surface of the blades permit the cooling air to exit the interior passages and form film cooling along the exterior surfaces of the blades. Further, some prior art blades have cooling holes extending between interior passages for directing jets of air from an upstream passage to a downstream passage so the jets impinge on an interior surface of the blades to cool the surface by impingement cooling. After impinging the surface, the cooling air is directed through film cooling holes rather than being used for additional convective cooling because it is heated too much to provide additional convective heat transfer benefit. Similarly, some prior art turbine vanes include inserts having impingement cooling holes which direct jets of air to interior surfaces of the vanes. Like the prior art blades, the cooling air is immediately exhausted through film cooling holes in the vanes after impinging the interior surface of the vanes because the cooling air is heated too much to provide additional convective heat transfer benefit.

SUMMARY OF THE INVENTION

Among the several features of the present invention may be noted the provision of an airfoil for use in a gas turbine engine. The airfoil includes a body having an interior surface defining a hollow cavity in the airfoil having an inlet and an outlet. The airfoil also includes a partition within the cavity dividing the cavity into a first cooling passage and a second cooling passage. The first cooling passage communicates with the inlet for delivering cooling air to the first passage and the second cooling passage communicates with the outlet for exhausting cooling air from the second passage. The partition has a cooling hole therein extending between the first passage and the second passage permitting cooling air to pass from the first passage to the second passage. The cooling hole is sized and positioned with respect to the interior surface of the airfoil for directing cooling air toward a portion of the interior surface of the airfoil so the cooling air impinges upon the portion. Thus, cooling air entering the inlet of the cavity travels through the first passage for cooling the body by convective heat transfer, through the cooling hole for impinging upon the portion of the interior surface of the body, through the second passage to cool the body by convective heat transfer, and out the outlet of the cavity.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
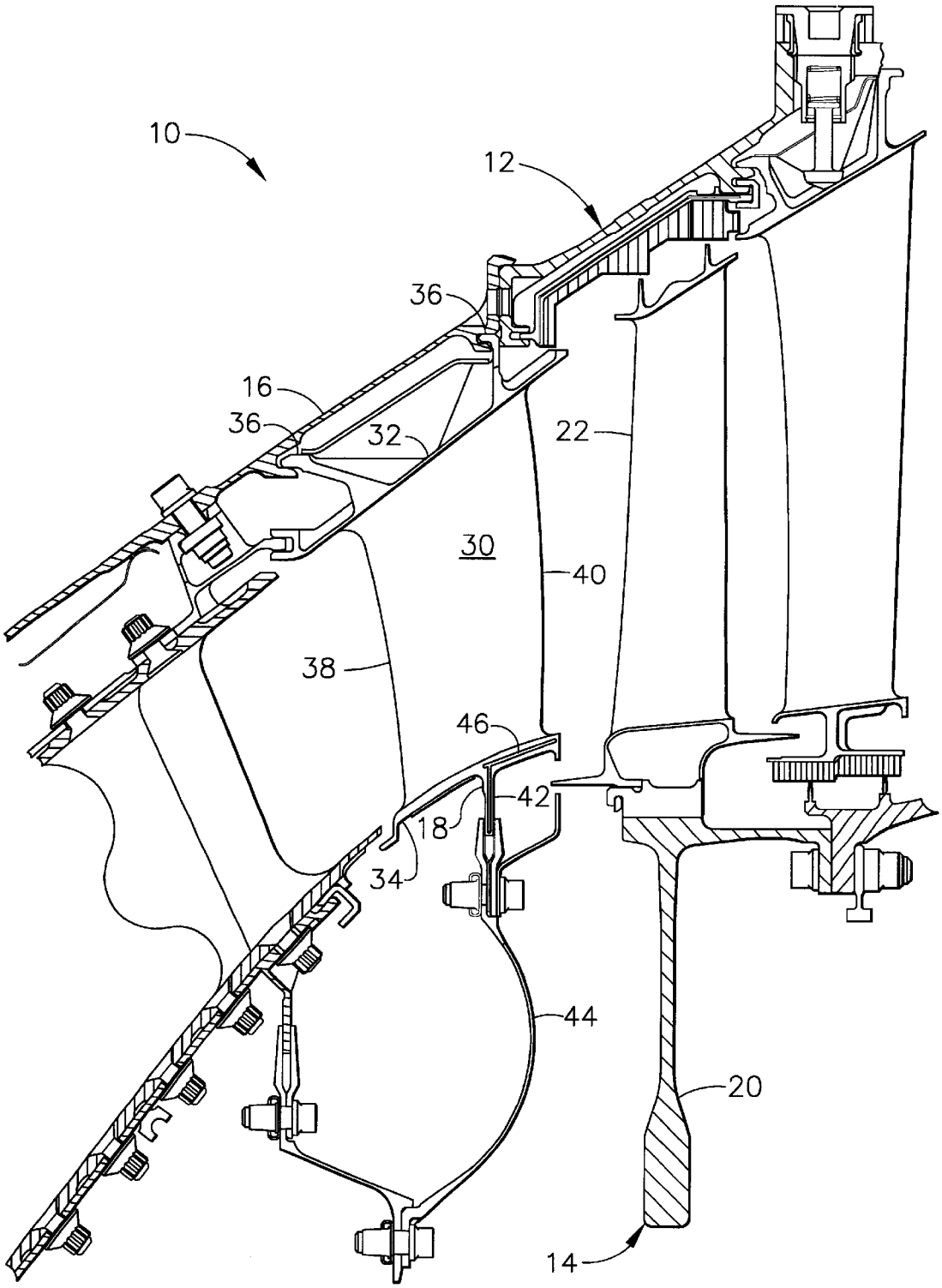
FIG. 1 is a vertical cross section of a portion of a gas turbine engine having an impingement cooled airfoil of the present invention.

Referring now to the drawings and in particular to FIG. 1, a portion of a gas turbine engine is designated in its entirety by the reference character 10. The engine 10 includes a stator, generally designated by 12, and a rotor, generally designated by 14, rotatably mounted on the stator. Among other features, the stator 12 includes a generally cylindrical support 16 holding a circumferential row of first stage low pressure turbine vane segments 18. The rotor 14 includes an annular disk 20 holding a circumferential row of first stage low pressure turbine blades 22 which rotate with respect to the vane segments 18 to drive a fan or compressor rotor (not shown) of the engine 10. Other than the first stage vane segments 18, the engine 10 is conventional and will not be described in further detail.

As further illustrated in FIG. 1, each vane segment 18 includes three airfoil bodies 30 extending radially between an outer platform 32 which forms an outer boundary of a flowpath of the engine 10, and an inner platform 34 which forms an inner boundary of the flowpath. Although the segment 18 of one preferred embodiment has three bodies 30, those skilled in the art will appreciate that the segment may have fewer or more airfoil bodies without departing from the scope of the present invention. The outer platform 32 has two hook mounts 36 for mounting the vane segment 18 on the support 16. Although the vane segment 18 of the preferred embodiment has two hook mounts 36, those skilled in the art will appreciate that fewer or more mounts and other types of mounts such as bolted flanges may be used without departing from the scope of the present invention. Each airfoil body 30 has a leading edge 38 facing generally upstream when the vane segment 18 is mounted in the engine 10. The body 30 also has a trailing edge 40 opposite the leading edge 38. The trailing edge 40 faces downstream when the vane segment 18 is mounted in the engine 10. A flange 42 extends inward from the inner platform 34 for supporting an inner seal 44. Grooves 46 are machined in each end of the inner platform 34. These grooves 46 accept conventional spline seals (not shown) to prevent flowpath gases from traveling between the ends of the inner platform 34.

Figure 2:
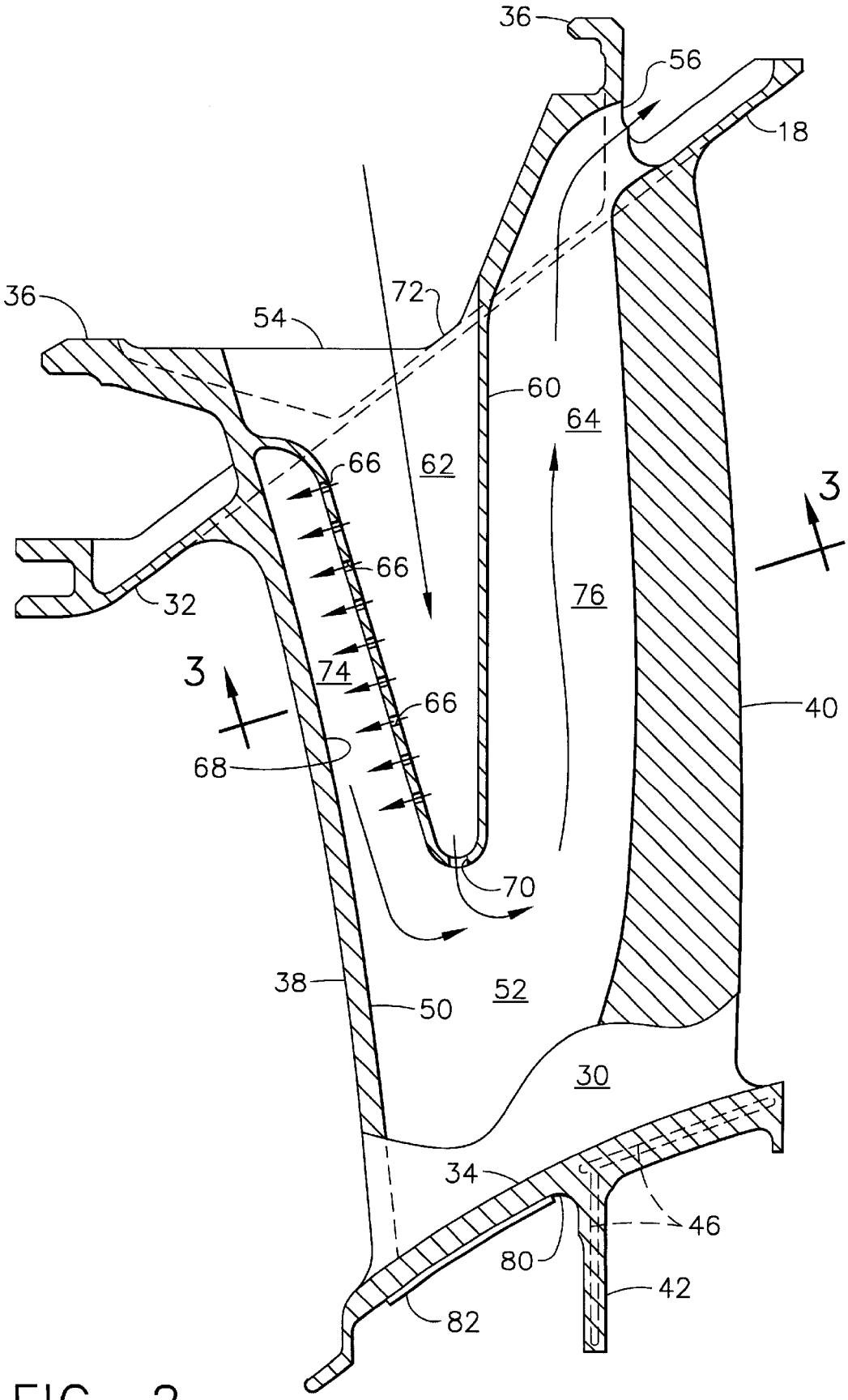
FIG. 2 is a vertical cross section of the airfoil of the present invention.
Figure 3:
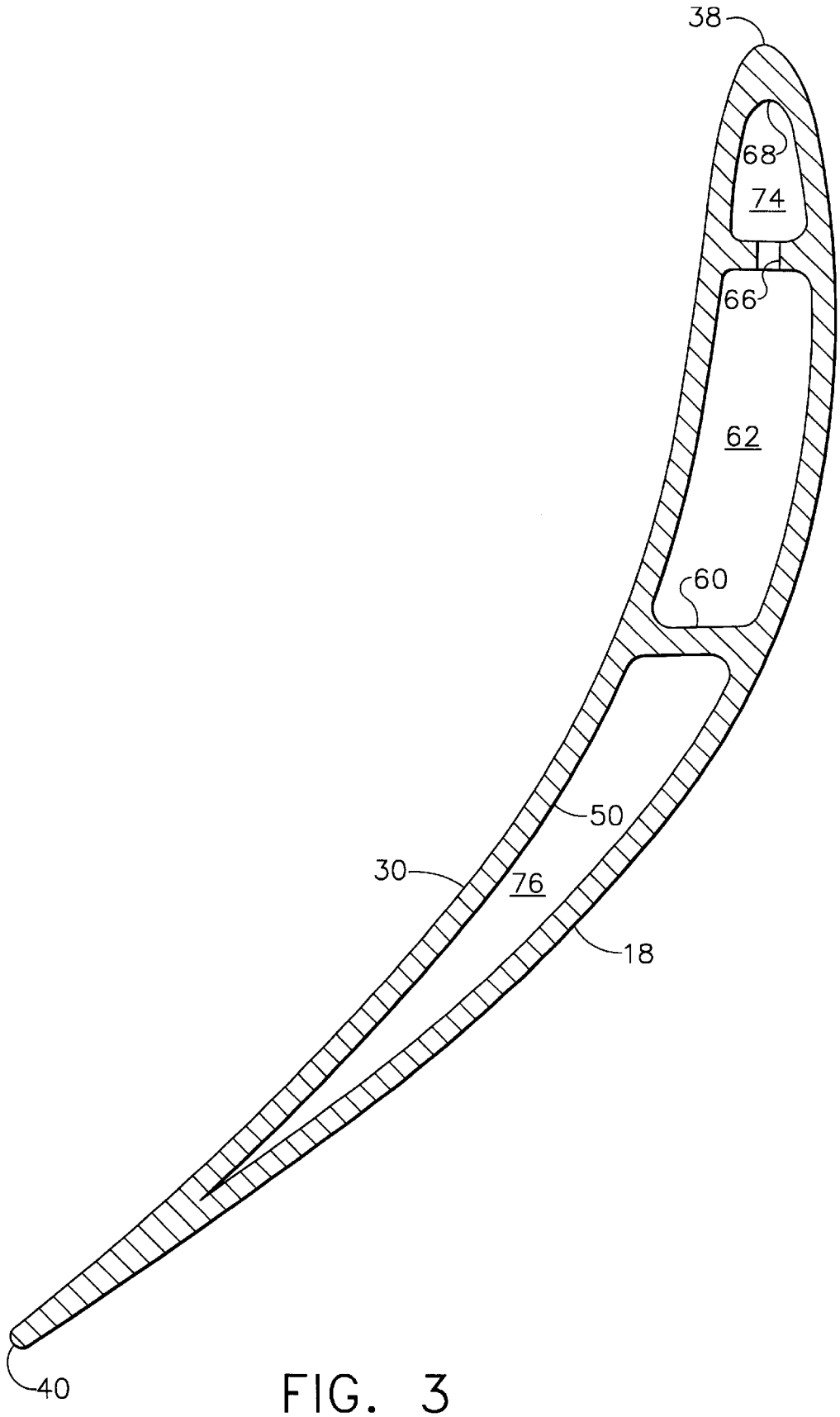
FIG. 3 is a cross section of the airfoil taken in the plane of line 3-3 of FIG. 2.
Figure 4:
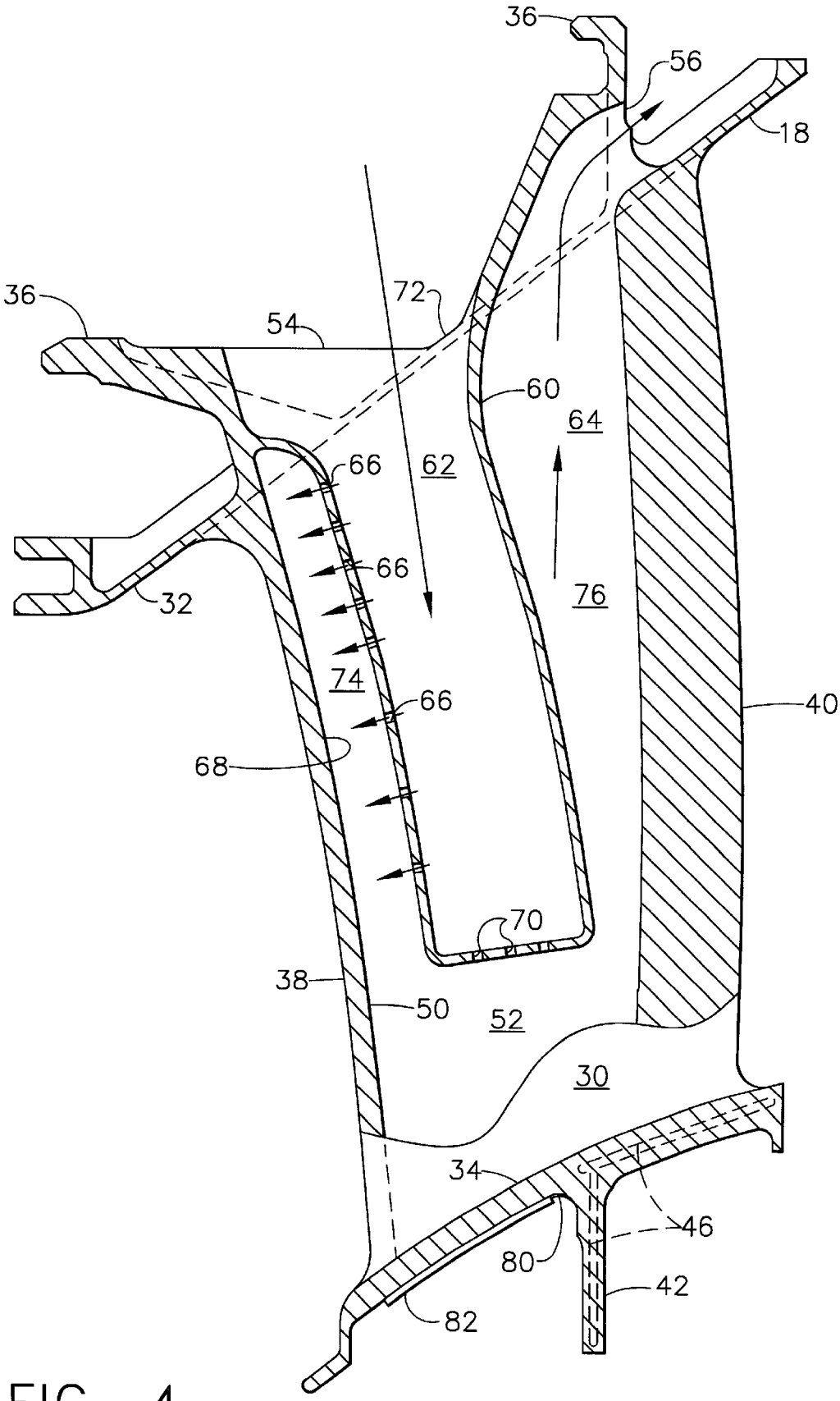
FIG. 4 is a vertical cross section of a second embodiment of the airfoil of the present invention.

As illustrated in FIGS. 2 and 3, the airfoil body 30 has an interior surface 50 defining a hollow cavity 52. The cavity 52 has an inlet 54 in communication with a source of cooling air (not shown) for admitting cooling air to the cavity 52 and an outlet 56 for exhausting cooling air from the cavity. Thus, cooling air passes through the cavity 52 from the inlet 54 to the outlet 56 for cooling the body 30 by convective heat transfer. A U-shaped partition or wall 60 extends across the cavity 52 dividing the cavity into a first cooling passage 62 and a second cooling passage 64. The first cooling passage 62 communicates with the inlet 54 for delivering cooling air to the first passage, and the second passage 64 communicates with the outlet 56 for exhausting cooling air from the second passage. Although the partition 60 of the embodiment shown in FIGS. 2 and 3 extends entirely across the cavity 52, it is envisioned that the partition could extend only partially across the cavity without departing from the scope of the present invention. Further, the partition 60 may have shapes other than shown in FIG. 2 without departing from the scope of the present invention. For example, the partition may have a partially rectangular shape as illustrated in FIG. 4.

As further illustrated in FIG. 2, a plurality of cooling holes 66 extends through the partition 60 between the first passage 62 and the second passage 64. These cooling holes 66 permit cooling air to pass from the first passage 62 to the second passage 64. The cooling holes 66 are sized and positioned with respect to the interior surface 50 of the body 30 for directing cooling air toward a portion 68 of the interior surface 50 of the body immediately adjacent the leading edge 38 of the body 30 as shown in FIG. 3. Thus, cooling air impinges upon the portion 68 of the interior surface 50 immediately adjacent the leading edge 38 to cool the body 30 by impingement cooling. As will be appreciated by those skilled in the art, the leading edge 38 of the airfoil body 30 typically experiences higher temperatures and/or stresses than other portions of the body. Thus, directing air to the leading edge 38 directs cooling air where it is most needed to reduce the maximum temperature and/or to enhance the material properties. Although the cooling holes 66 of the preferred embodiment direct cooling air to the portion 68 of the interior surface 50 immediately adjacent the leading edge 38, the cooling holes may direct air to other portions of the interior surface without departing from the scope of the present invention.

As will be appreciated by those skilled in the art, distances between individual cooling holes 66 and the interior surface 50 immediately adjacent the leading edge 38 edge may be selected to control the heat transfer effectiveness of the impingement cooling and to account for cross flow of cooling air between the holes and the interior surface. For example, in one preferred embodiment, the distance between the upper-most cooling hole 66 and the interior surface 50 is about 0.24 inches and the distance between the lower-most cooling hole 66 and the interior surface 50 is about 0.28 inches. However, it is envisioned that the distance between the cooling holes 66 and the interior surface 50 may vary without departing from the scope of the present invention. For example, the distance between the cooling holes 66 and the interior surface 50 may vary as shown in FIG. 4 without departing from the scope of the present invention. Further, although the cooling holes 66 of the embodiment shown in FIG. 2 are positioned in a straight portion of the barrier 60, those skilled in the art will appreciate that the barrier may be curved to obtain optimum distances between each cooling hole 66 and the interior surface 50. In addition, although in embodiment illustrated in FIG. 2 has cooling holes 66 distributed between about 50 percent span and about 100 percent span, those skilled in the art will appreciate that the cooling holes may be positioned to cool other portions of the airfoil bodies 30 without departing from the scope of the preferred embodiment. Still further, the spacing between adjacent cooling holes 66 may vary along the airfoil body 30 as shown in FIG. 4 without departing from the scope of the present invention.

As further illustrated in FIG. 2, the partition 60 includes a metering hole or opening 70 extending between the first and second passages 62, 64, respectively. The opening 70 is positioned with respect to the interior surface 50 of the body 30 to permit cooling air to pass from the first passage 62 to the second passage 64 without impinging upon the interior surface of the body. Because the air passes through the opening 70 without impinging the interior surface 50, less heat is transferred to the air so it remains cooler than it would if it impinged the surface. Consequently, the air downstream is cooler than it would be if all the air impinged the interior surface 50. This results in a more gradual chord-wise temperature gradient which results in lower stresses in the airfoil body. In one preferred embodiment the opening 70 is positioned at the bottom or lower end of the U-shaped partition 60 so air is directed downward away from the interior surface 50. The opening 70 has a predetermined size selected to ensure a sufficient amount of cooling air passes through the second passage 64 without impinging on the interior surface 50 of the body 30 so the air temperature of all the cooling air passing through the second passage 64 (i.e., the air that passed through the cooling holes 66 and the air that passed through the opening 70) is sufficiently low to provide effective convective cooling in the second passage. Calculation of the flow balances and necessary air flows needed to cool the body 30 is well within the understanding and ability of those of ordinary skill in the art. In one preferred embodiment, the opening 70 is sized so that approximately one third of the air entering the first passage 62 travels through the opening and two thirds travels through the impingement cooling holes 66. Thus, about half as much cooling air passes through the second passage 64 without impinging upon the interior surface 50 of the body 30 as passes through the second passage and impinges upon the interior surface of the body. Although the cooling holes 66 and opening 70 may have other diameters without departing from the scope of the present invention, in one preferred embodiment having nine cooling holes and a pressure drop across the partition 60 of about 10–15 pounds per square inch, the cooling holes have a diameter of about 0.04 inches and the opening has a diameter of about 0.09 inches. Further, although the cooling holes 66 and opening 70 may have other shapes without departing from the scope of the present invention, in one preferred embodiment the holes are circular. Although only one opening 70 is present in the embodiment shown in FIG. 2, those skilled in the art will appreciate that the partition 60 may have more than one opening without departing from the scope of the present invention.

Cooling air entering the inlet 54 of the cavity 52 at an outboard end 72 of the body 30 travels generally radially inward through the first passage 62 cooling the body by convective heat transfer. Some of the cooling air passes through the cooling holes 66 and impinges upon the portion 68 of the interior surface 50 in the body 30 immediately adjacent the leading edge 38 of the body cooling the body by impingement cooling. After impinging the interior surface 50, the cooling air passing through the cooling holes 66 travels generally radially inward through a first section 74 of the second passage 64. After traveling through the first section 74, the cooling air mixes with cooling air traveling through the opening 70. Then the mixed cooling air turns and travels generally radially outward through a second section 76 of the second passage to cool the body 30 by convective heat transfer. Eventually, the cooling air exits the cavity 52 through the outlet 56 at the outboard end 72 of the body. After exiting the cavity 52, the cooling air may be used to cool other features of the engine 10 such as tips of the blades 22.

The previously described vane segment 18 is manufactured using a conventional process. The segment 18 is cast using a core (not shown) which creates the cavity 52, partition 60, opening 70 and cooling holes 66. An opening (not shown) is formed in an inboard end 80 of the segment 18 by the core. This opening is closed by a sheet metal strip 82 which is brazed or otherwise fastened to the segment 18 using a conventional process. The casting is machined to a final part shape using conventional machining processes.

Although a stator vane segment 18 having impingement cooling has been described above, those of ordinary skill in the art will appreciate that the present invention may be applied to other airfoils such as rotor blades. Further, although the airfoil of the preferred embodiment is a first stage low pressure turbine vane, similar impingement cooling may be used in other stages of the low pressure turbine or high pressure turbine without departing from the scope of the present invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. An airfoil for use in a gas turbine engine comprising:

a body having a leading edge and a trailing edge opposite said leading edge, the body having an interior surface defining a hollow cavity in the airfoil having an inlet in communication with a source of cooling air for admitting cooling air to the cavity and an outlet for exhausting cooling air from the cavity thereby permitting cooling air to pass through the cavity from the inlet to the outlet to cool the airfoil body by convective heat transfer; and a partition within the cavity extending entirely across the cavity and dividing the cavity into a first cooling passage and a second cooling passage, said first cooling passage communicating with the inlet for delivering cooling air to the first passage and said second cooling passage communicating with the outlet for exhausting cooling air from the second passage, the partition having a cooling hole therein extending between said first passage and said second passage and permitting cooling air to pass from said first passage to said second passage, said cooling hole being sized and positioned with respect to the interior surface of the airfoil body for directing cooling air toward a portion of the interior surface of the airfoil body so the cooling air impinges upon the portion thereby cooling the body by impingement cooling, wherein cooling air entering the inlet of the cavity travels through said first passage for cooling the body by convective heat transfer, through the cooling hole for impinging upon the portion of the interior surface of the body thereby cooling the body by impingement cooling, through said second passage to cool the body by convective heat transfer, and out the outlet of the cavity.

2. An airfoil as set forth in claim 1 wherein said cooling hole is a first cooling hole and said partition has a plurality of cooling holes including said first cooling hole, each of said plurality of cooling holes being sized and positioned with respect to the interior surface of the airfoil body to direct cooling air toward a portion of the interior surface of the airfoil body defining the interior cavity so the cooling air impinges upon the portion of the interior surface thereby cooling the body by impingement cooling.

3. An airfoil as set forth in claim 2 wherein each of said plurality of cooling holes is sized and positioned with respect to the interior surface of the airfoil body to direct cooling air toward the interior surface adjacent the leading edge of the airfoil body to remove heat from the leading edge of the airfoil body.

4. An airfoil as set forth in claim 2 wherein each of said plurality of cooling holes is spaced from the interior surface of the airfoil body by a distance selected to achieve a predetermined heat transfer effectiveness.

5. An airfoil as set forth in claim 2 wherein the partition includes an opening extending between said first passage and said second passage sized and positioned with respect to the interior surface of the airfoil body to permit cooling air to pass from said first passage to said second passage without passing through said plurality of cooling holes and without impinging on the interior surface of the airfoil body.

6. An airfoil as set forth in claim 5 wherein the opening has a predetermined size selected to ensure that a predetermined amount of cooling air passes through said second passage without impinging upon the interior surface of the body.

7. An airfoil as set forth in claim 6 wherein the predetermined size of the opening is selected to ensure about half as much cooling air passes through said second passage without impinging upon the interior surface of the body as passes through said second passage and impinges upon the interior surface of the body.

8. An airfoil as set forth in claim 1 wherein said airfoil is a turbine stator vane.

9. An airfoil as set forth in claim 8 having three bodies, each of said bodies having a leading edge, a trailing edge opposite said leading edge, and an interior surface defining a hollow cavity in the airfoil having an inlet in communication with a source of cooling air for admitting cooling air to the cavity and an outlet for exhausting cooling air from the cavity.

10. An airfoil as set forth in claim 1 wherein said body includes a mount for mounting the airfoil in the gas turbine engine.

11. An airfoil as set forth in claim 10 wherein the body has two mounts.

12. An airfoil as set forth in claim 11 wherein each of said mounts is a hook mount.

13. An airfoil as set forth in claim 1 wherein the partition extends radially with respect to the airfoil body from about 50 percent span to about 100 percent span.

14. An airfoil as set forth in claim 1 wherein the partition is U-shaped.

15. An airfoil as set forth in claim 14 wherein said second passage is U-shaped.

16. An airfoil for use in a gas turbine engine comprising:

a body having a leading edge and a trailing edge opposite said leading edge, the body having an interior surface defining a hollow cavity in the airfoil having an inlet in communication with a source of cooling air for admitting cooling air to the cavity and an outlet for exhausting cooling air from the cavity thereby permitting cooling air to pass through the cavity from the inlet to the outlet to cool the airfoil body by convective heat transfer; and a U-shaped partition within the cavity dividing the cavity into a first cooling passage and a second cooling passage, said first cooling passage communicating with the inlet for delivering cooling air to the first passage and said second cooling passage communicating with the outlet for exhausting cooling air from the second passage, the partition having a cooling hole therein extending between said first passage and said second passage and permitting cooling air to pass from said first passage to said second passage, said cooling hole being sized and positioned with respect to the interior surface of the airfoil body for directing cooling air toward a portion of the interior surface of the airfoil body so the cooling air impinges upon the portion thereby cooling the body by impingement cooling, the partition having an opening extending between said first passage and said second passage at a lower end of the partition to permit cooling air to pass from said first passage to said second passage without passing through said cooling hole and without impinging on the interior surface of the airfoil body, wherein cooling air entering the inlet of the cavity travels through said first passage for cooling the body by convective heat transfer, through the cooling hole for impinging upon the portion of the interior surface of the body thereby cooling the body by impingement cooling, through said second passage to cool the body by convective heat transfer, and out the outlet of the cavity.

17. An airfoil for use in a gas turbine engine comprising:

a body having a leading edge and a trailing edge opposite said leading edge, the body having an interior surface defining a hollow cavity in the airfoil having an inlet in communication with a source of cooling air for admitting cooling air to the cavity and an outlet for exhausting cooling air from the cavity thereby permitting cooling air to pass through the cavity from the inlet to the outlet to cool the airfoil body by convective heat transfer; and a U-shaped partition within the cavity dividing the cavity into a first cooling passage and a U-shaped second cooling passage, said first cooling passage communicating with the inlet for delivering cooling air to the first passage and said second cooling passage communicating with the cutlet for exhausting cooling air from the second passage, the partition having a cooling hole therein extending between said first passage and said second passage and permitting cooling air to pass from said first passage to said second passage, said cooling hole being sized and positioned with respect to the interior surface of the airfoil body for directing cooling air toward a portion of the interior surface of the airfoil body so the cooling air impinges upon the portion thereby cooling the body by impingement cooling, wherein cooling air entering the inlet of the cavity travels through said first passage for cooling the body by convective heat transfer, through the cooling hole for impinging upon the portion of the interior surface of the body thereby cooling the body by impingement cooling, through said second passage to cool the body by convective heat transfer, and out the outlet of the cavity, and wherein said first cooling passage directs cooling air generally radially inward through the airfoil body, and said second cooling passage includes a first section which directs cooling air generally radially inward through the airfoil body and a second section which directs cooling air generally radially outward through the airfoil body.

18. An airfoil as set forth in claim 17 wherein both the inlet and the outlet are positioned at an outboard end of the airfoil.

19. An airfoil as set forth in claim 17 wherein said first cooling passage is positioned between said first section and said second section.

* * * * *